US012209393B2

(12) United States Patent
Brosh et al.

(10) Patent No.: US 12,209,393 B2
(45) Date of Patent: Jan. 28, 2025

(54) GRADE CONTROL SYSTEMS AND METHODS FOR EARTHMOVING IMPLEMENTS

(71) Applicant: Caterpillar Trimble Control Technologies LLC, Dayton, OH (US)

(72) Inventors: Daniel Brosh, Dayton, OH (US); Christopher Corwin, Germantown Hills, IL (US); Kyle Davis, Xenia, OH (US); Seth Meisel, Westminster, CO (US)

(73) Assignee: Caterpillar Trimble Control Technologies LLC, Dayton, OH (US)

( * ) Notice: Subject to any disclaimer, the term of this patent is extended or adjusted under 35 U.S.C. 154(b) by 357 days.

(21) Appl. No.: 17/880,864

(22) Filed: Aug. 4, 2022

(65) Prior Publication Data

US 2024/0044111 A1 Feb. 8, 2024

(51) Int. Cl.
*E02F 9/26* (2006.01)
*E02F 9/20* (2006.01)

(52) U.S. Cl.
CPC ..... *E02F 9/265* (2013.01); *E02F 9/2041* (2013.01); *E02F 9/262* (2013.01)

(58) Field of Classification Search
None
See application file for complete search history.

(56) References Cited

U.S. PATENT DOCUMENTS 8,689,471 B2 4/2014 Carpenter et al.
9,493,929 B2 11/2016 Kurihara et al.
(Continued)

FOREIGN PATENT DOCUMENTS

EP 4006235 A1 * 6/2022 ..... E02F 3/28
JP 2001098585 A * 4/2001
KR 102028750 B1 10/2019

OTHER PUBLICATIONS

Fritsch, F.N., and Carlson, R.E. "Monotone Piecewise Cubic Interpolation", SIAM J. Numer. Anal., vol. 17, No. 2, Apr. 1980. (Year: 1980).*

(Continued)

*Primary Examiner* — Jelani A Smith
*Assistant Examiner* — Samantha P. Pelow
(74) *Attorney, Agent, or Firm* — Dinsmore & Shohl LLP

(57) ABSTRACT

Grade control systems and methods for an earthmoving machine and control architecture to generate a continuous differential surface associated with a rear curved surface of an earthmoving implement, project the continuous differential surface onto a two-dimensional (2D) plane associated with the earthmoving implement, determine a piecewise-derivative continuous curve based on the continuous differential surface projected on to the 2D plane, determine a derivative of the piecewise-derivative continuous curve, project a design plane normal n* of a ground surface for smoothing onto the 2D plane associated with the earthmoving implement, determine a point of perpendicular intersection between the derivative of the piecewise-derivative continuous curve and the design plane normal n* of the ground surface projected onto the 2D plane, and operate the earthmoving machine using one or more linkage assembly actuators and the point of perpendicular intersection to smooth the ground surface.

20 Claims, 6 Drawing Sheets

(56) References Cited

U.S. PATENT DOCUMENTS

| | | | | |
|---|---|---|---|---|
| 2008/0000111 | A1 | 1/2008 | Green | |
| 2008/0047170 | A1 | 2/2008 | Nichols | |
| 2017/0314234 | A1* | 11/2017 | Paull | E02F 3/32 |
| 2018/0340316 | A1* | 11/2018 | Izumikawa | E02F 3/435 |
| 2019/0345696 | A1 | 11/2019 | Hansby | |
| 2019/0368160 | A1* | 12/2019 | Green | G01C 21/20 |
| 2024/0247461 | A1* | 7/2024 | Brabec | E02F 3/435 |

OTHER PUBLICATIONS

Fritsch, F.N., and Carlson, R.E. "Monotone Piecewise Cubic Interpolation", SIAM J. Numer. Anal., vol. 17, No. 2, Apr. 1980.

International Search Report and Written Opinion dated Oct. 27, 2023 issued in International Application No. PCT/ US2023/071582 filed Aug. 3, 2023.

* cited by examiner

GRADE CONTROL SYSTEMS AND METHODS FOR EARTHMOVING IMPLEMENTS

BACKGROUND

The present disclosure relates to earthmoving implements such as excavators which, for the purposes of defining and describing the scope of the present application, comprise an excavator boom and an excavator stick subject to swing and curl, and an excavating implement that is subject to swing and curl control with the aid of the excavator boom and excavator stick, or other similar components for executing swing and curl movement. The excavating implement, as an earthmoving implement, may be use to smooth a ground surface in grade control operations and to move earth and other ground components with respect to the ground surface. For example, and not by way of limitation, many types of excavators comprise a hydraulically or pneumatically or electrically controlled excavating implement that can be manipulated by controlling the swing and curl functions of an excavating linkage assembly of the excavator. Excavator technology is, for example, well represented by the disclosures of U.S. Pat. No. 8,689,471, which is assigned to Caterpillar Trimble Control Technologies LLC and discloses methodology for sensor-based automatic control of an excavator, US 2008/0047170, which is assigned to Caterpillar Trimble Control Technologies LLC and discloses an excavator 3D laser system and radio positioning guidance system configured to guide a cutting edge of an excavator bucket with high vertical accuracy, and US 2008/0000111, which is assigned to Caterpillar Trimble Control Technologies LLC and discloses methodology for an excavator control system to determine an orientation of an excavator sitting on a sloped site.

BRIEF SUMMARY

According to the subject matter of the present disclosure, a grade control system comprises an earthmoving machine, the earthmoving machine comprising a machine chassis, a linkage assembly, an earthmoving implement, and control architecture. The control architecture comprises one or more linkage assembly actuators and an architecture controller programmed to generate a continuous differential surface associated with a rear curved surface of the earthmoving implement and project the continuous differential surface onto a two-dimensional (2D) plane associated with the earthmoving implement. The architecture controller is further programmed to determine a piecewise-derivative continuous curve based on the continuous differential surface projected on to the 2D plane and determine a derivative of the piecewise-derivative continuous curve. The architecture controller is further programmed to project a design plane normal n* of a ground surface for smoothing onto the 2D plane associated with the earthmoving implement, determine a point of perpendicular intersection between the derivative of the piecewise-derivative continuous curve and the design plane normal n* of the ground surface projected onto the 2D plane, and operate the earthmoving machine using the one or more linkage assembly actuators and the point of perpendicular intersection to smooth the ground surface.

In accordance with one embodiment of the present disclosure, a grade control system comprises an earthmoving machine, the earthmoving machine comprising a machine chassis, a linkage assembly, an earthmoving implement, and control architecture, the linkage assembly of the earthmoving implement comprising a boom linkage and a stick linkage each comprising a centerline. The control architecture comprises one or more linkage assembly actuators that facilitate movement of the linkage assembly and an architecture controller. The architecture controller is programmed to generate a continuous differential surface associated with a rear curved surface of the earthmoving implement and project the continuous differential surface onto a two-dimensional (2D) plane associated with the earthmoving implement. The 2D plane associated with the earthmoving implement passes through each centerline of the boom linkage and the stick linkage. The architecture controller is further programmed to determine a piecewise-derivative continuous curve based on the continuous differential surface projected on to the 2D plane, determine a derivative of the piecewise-derivative continuous curve, and project a design plane normal n* of a ground surface for smoothing onto the 2D plane associated with the earthmoving implement. The architecture controller is further programmed to determine a point of perpendicular intersection between the derivative of the piecewise-derivative continuous curve and the design plane normal n* of the ground surface projected onto the 2D plane, and operate the earthmoving machine using the one or more linkage assembly actuators and the point of perpendicular intersection to smooth the ground surface.

In accordance with one other embodiment of the present disclosure, a method to operate a grade control system comprising an earthmoving machine, the earthmoving machine comprising a machine chassis, a linkage assembly, an earthmoving implement, and control architecture comprising one or more linkage assembly actuators and an architecture controller, comprises generating, via the architecture controller, a continuous differential surface associated with a rear curved surface of the earthmoving implement. The method further comprises projecting the continuous differential surface onto a two-dimensional (2D) plane associated with the earthmoving implement, determining a piecewise-derivative continuous curve based on the continuous differential surface projected on to the 2D plane, determining a derivative of the piecewise-derivative continuous curve, and projecting a design plane normal n* of a ground surface for smoothing onto the 2D plane associated with the earthmoving implement. The method further comprises determining, via the architecture controller, a point of perpendicular intersection between the derivative of the piecewise-derivative continuous curve and the design plane normal n* of the ground surface projected onto the 2D plane, and operating the earthmoving machine using the architecture controller, the one or more linkage assembly actuators, and the point of perpendicular intersection to smooth the ground surface.

Although the concepts of the present disclosure are described herein with primary reference to the excavator illustrated in FIG. 1, it is contemplated that the concepts will enjoy applicability to any type of excavator, regardless of its particular mechanical configuration. For example, and not by way of limitation, the concepts may enjoy applicability to a backhoe loader including a backhoe linkage, an excavator containing a variable angle boom, a tilt-rotator attachment, or the like earthmoving machinery.

BRIEF DESCRIPTION OF THE SEVERAL VIEWS OF THE DRAWINGS

The following detailed description of specific embodiments of the present disclosure can be best understood when read in conjunction with the following drawings, where like structure is indicated with like reference numerals and in which.

DETAILED DESCRIPTION

The present disclosure relates to earthmoving machines and, more particularly, to earthmoving machines such as excavators including components subject to control. For example, and not by way of limitation, many types of excavators typically have a hydraulically controlled earthmoving implement that can be manipulated by a joystick or other means in an operator control station of the machine, and is also subject to partially or fully automated control. The user of the machine may control the lift, tilt, angle, and pitch of the implement. In addition, one or more of these variables may also be subject to partially or fully automated control based on information sensed or received by an adaptive environmental sensor of the machine. In the embodiments described herein, a grade control system is used to determine a value such as a point of perpendicular intersection between a rear curve of an earthmoving implement and a ground surface and operate the earthmoving machine to contact, such as to smooth, the ground surface with the earthmoving implement based on the point of perpendicular intersection, as described in greater detail further below. Such determined values may be utilized by an architecture control to operate the earthmoving machine.

As the earthmoving implement may be used in many different orientations with respect to a ground surface and connection via a linkage to the earthmoving machine, a point of the earthmoving implement contacting the ground surface is dynamically and changing with respect to a geometry of the linkage. The determined values may include determining a focus and vertical guidance point for grade control based on the determined dynamically changing point on the earthmoving implement by creating a vector disposed through a center point of the earthmoving implement and is perpendicular (e.g., normal) to the ground surface (e.g., a design surface). Thus, with such determined values such as the focus and vertical guidance point, a grade control system may maintain an accurate guidance as the earthmoving implement moves over the ground surface through a range of motion and number of linkage positions as achieved by the linkage.

Figure 1:
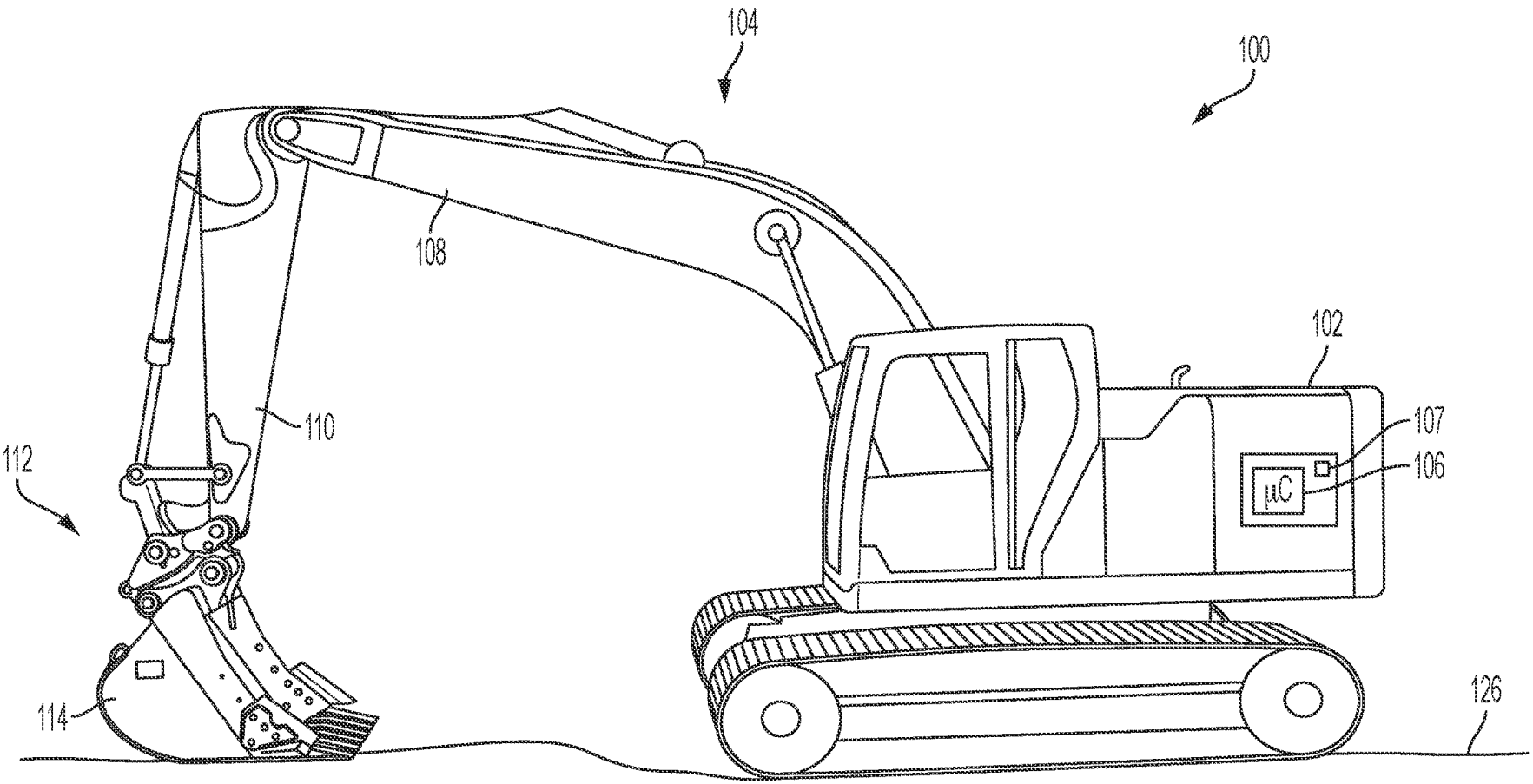
FIG. 1 is a side view of an earthmoving machine incorporating aspects of the present disclosure.

Referring initially to FIG. 1, in embodiments, a grade control system 107 includes an earthmoving machine 100, which is shown disposed on a ground surface 126. The earthmoving machine 100 includes a machine chassis 102, a linkage assembly 104, an earthmoving implement 114, and control architecture 106. The linkage assembly 104 includes a boom linkage 108, a stick linkage 110, the earthmoving implement 114, and a four-bar linkage 112 that collectively define a plurality of linkage assembly positions. The stick linkage 110 includes a terminal point and is mechanically coupled to a terminal pivot point of the boom linkage 108. The machine chassis 102 is mechanically coupled to an opposing terminal pivot point of the boom linkage 108. Thus, the boom linkage 108 is coupled between the machine chassis 102 and the stick linkage 110, and an end of the stick linkage 110 is coupled to the earthmoving implement 114, such as through the four-bar linkage 112.

In embodiments, the linkage assembly 104 is configured to swing with, or relative to, the machine chassis 102, and the stick linkage 110 is configured to curl relative to the boom linkage 108. Further, the earthmoving implement 114 and the stick linkage 110 are mechanically coupled to each other, such as through the four-bar linkage 112. In embodiments, the four-bar linkage 112 includes an implement linkage, a rear side linkage, a dogbone linkage, and a front side linkage.

Figure 6:
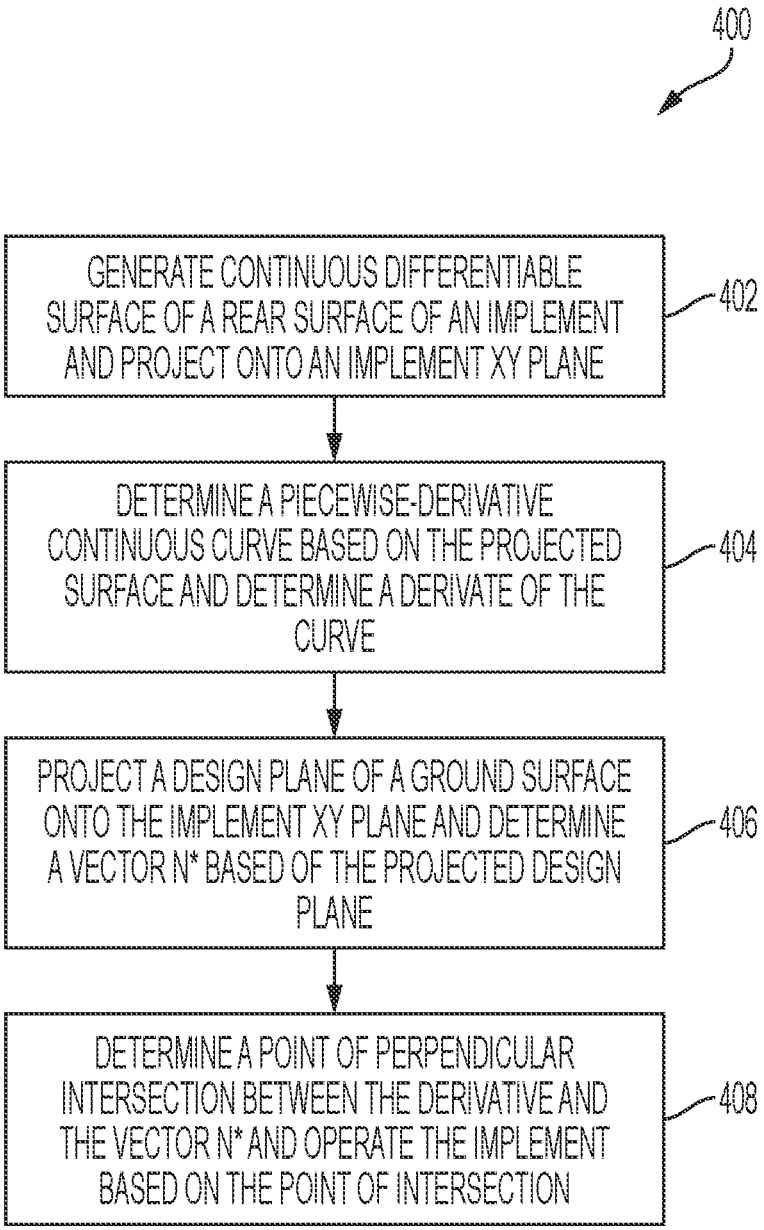
FIG. 6 is a flow chart of a process used to determine a point of perpendicular intersection between a surface point of an earthmoving implement of the earthmoving machine of FIG. 1 and a ground surface, according to various concepts of the present disclosure.

The control architecture 106 comprises one or more linkage assembly actuators and an architecture controller programmed to execute a control scheme 400 (FIG. 6) as described herein. In embodiments, the control architecture 106 comprises a non-transitory computer-readable storage medium comprising machine readable instructions. The one or more linkage assembly actuators may facilitate movement of the linkage assembly 104. The one or more linkage assembly actuators may comprise a hydraulic cylinder actuator, a pneumatic cylinder actuator, an electrical actuator, a mechanical actuator, or combinations thereof. Blocks 402-408 of the control scheme 400 of FIG. 6 illustrate the process the architecture controller is programmed to execute, which will be described in greater detail further below.

Figure 2:
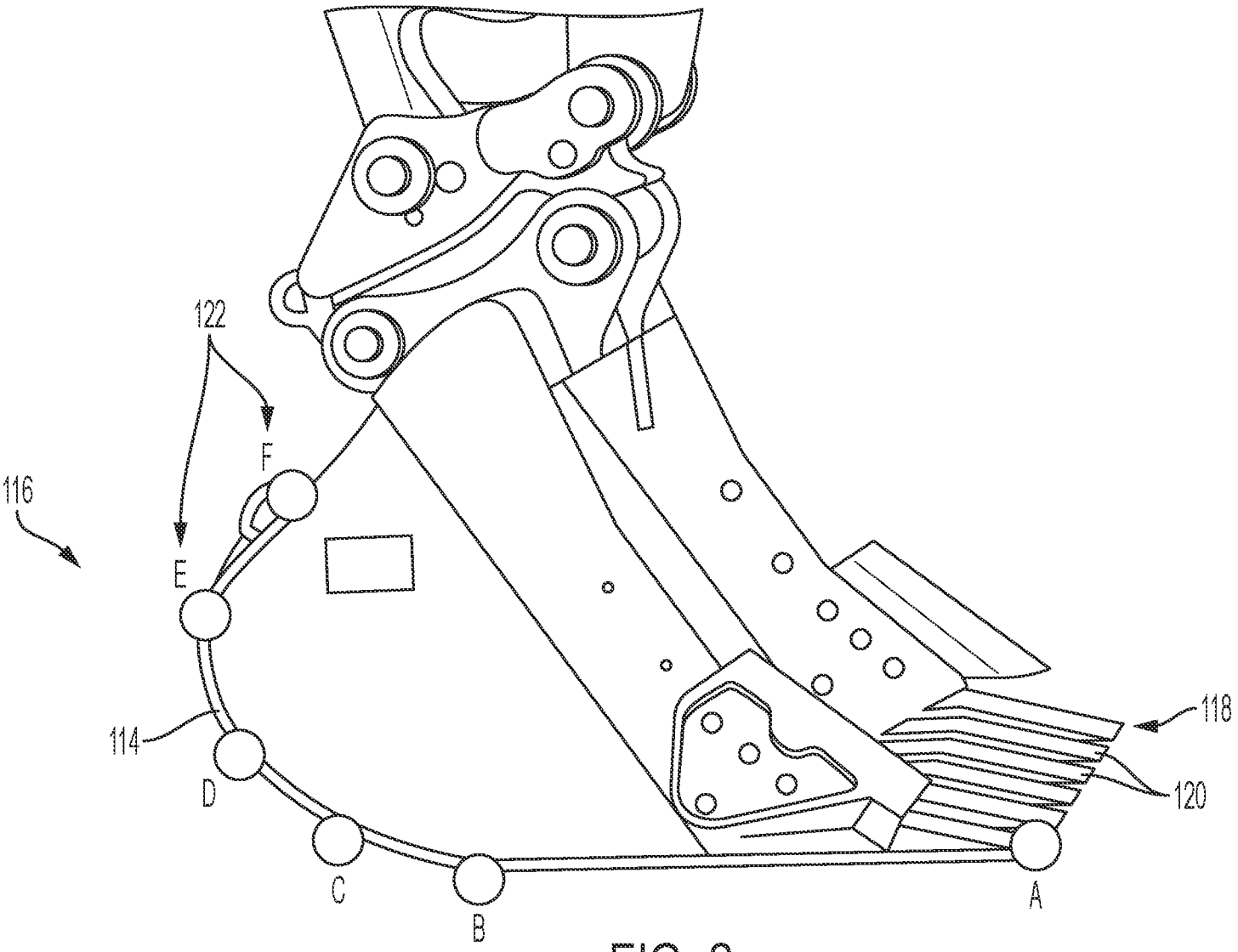
FIG. 2 is an enlarged perspective view of an earthmoving implement of the earthmoving machine of FIG. 1, according to various concepts of the present disclosure.

Referring to FIG. 2, an enlarged view of the earthmoving implement 114 is shown with a superimposed plurality of points 122 that form a superimposed curve 116. The superimposed curve 116 is representative of a continuous differential surface associated with a rear curved surface of the earthmoving implement 114.

Figure 3:
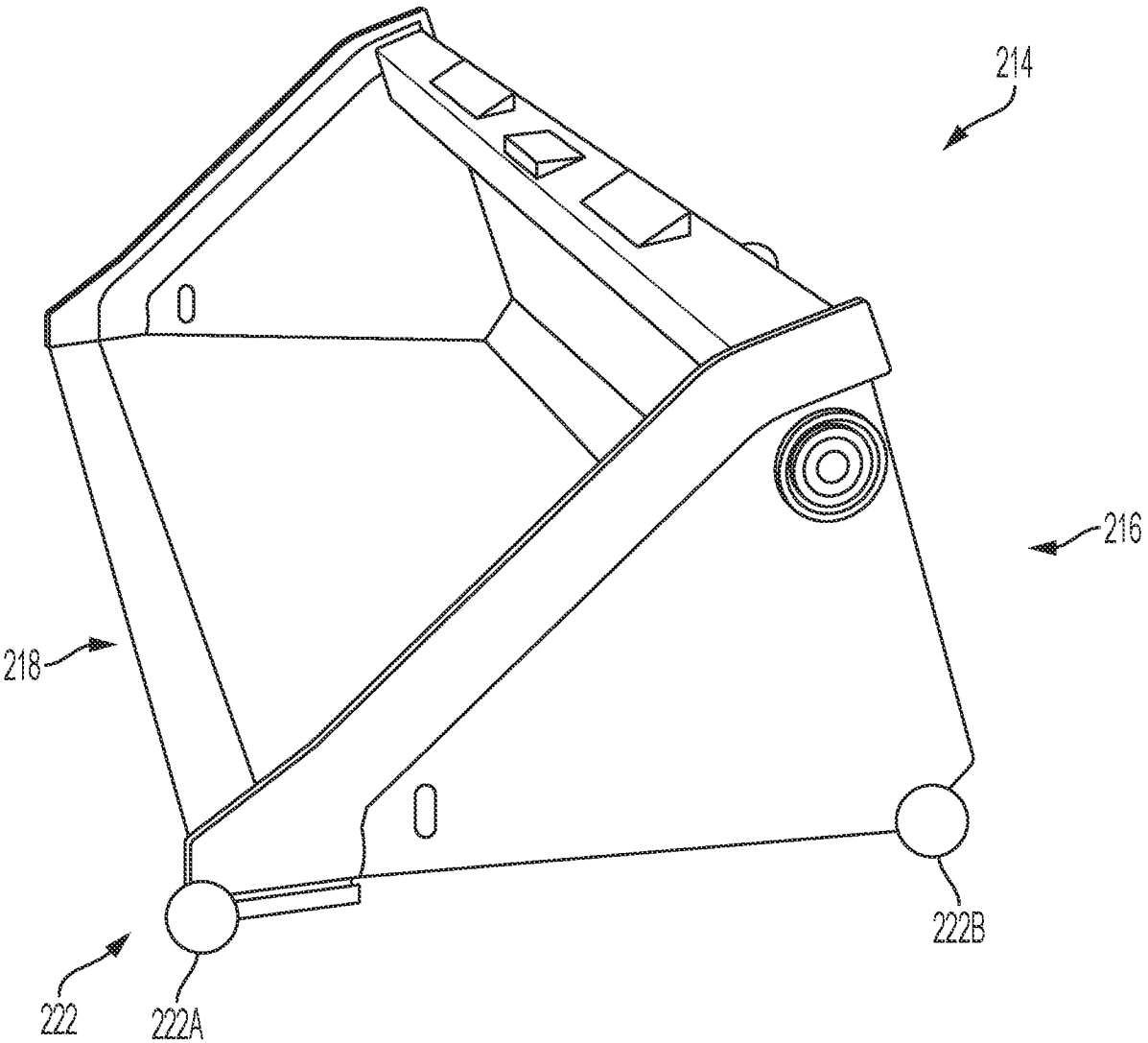
FIG. 3 is an enlarged perspective view of another embodiment of an earthmoving implement of the earthmoving machine of FIG. 1, according to various concepts of the present disclosure.

Referring to FIG. 3, an enlarged view of another embodiment of an earthmoving implement 214 is shown with superimposed one or more points 122 and an interior surface 218. The point 122 include superimposed front point 222A and superimposed rear point 222B, disposed at ends of a generally linear undersurface 216 of the earthmoving implement 216. The outer, generally linear undersurface 216 faces in an opposite direction from the interior surface 218 of the earthmoving implement 214. Thus, the generally linear undersurface 216 of the earthmoving implement 214 depicts a generally non-circular implement surface. For any curvature points, an intersection of a design plane normal n* of a ground surface 126 (e.g., a target ground surface 126 for smoothing) that is normal to a piecewise-derivative continuous curve (e.g., such as through a simulated arc) is determined via a process 400 (FIG. 6), which is described in greater detail below. As a non-limiting embodiment, in sections between linear regions, multiple sample points can be added between the adjoining segments to allow for a piecewise continuous derivative linear curve to be generated. For linear regions of the characterization curve of the earthmoving implement 214, a point on the front or rear edge of a line segment (e.g., the superimposed front point 222A and/or the superimposed rear point 222B) may be used with hysteresis to prevent bouncing and reduce error between focus points of the earthmoving implement 214 used in the process 400 for the determinations.

Figure 4:
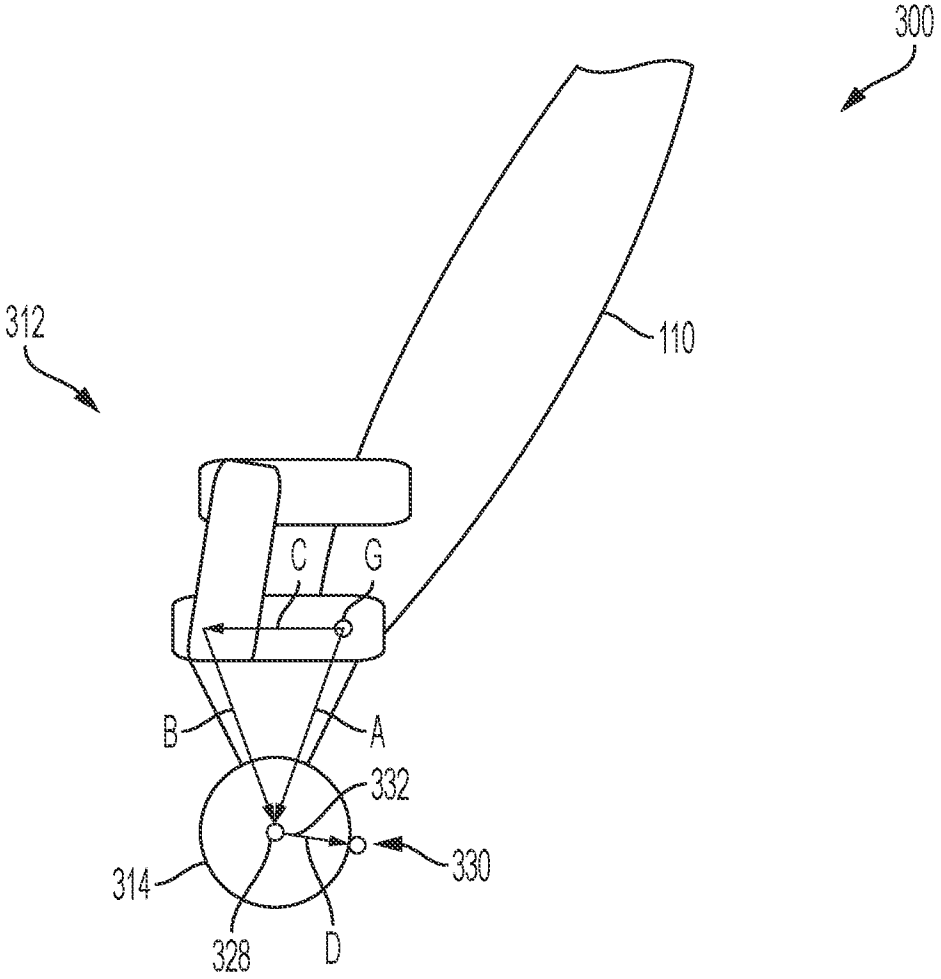
FIG. 4 is an enlarged perspective view of yet another embodiment of an earthmoving implement of the earthmoving machine of FIG. 1, according to various concepts of the present disclosure.
Figure 5:
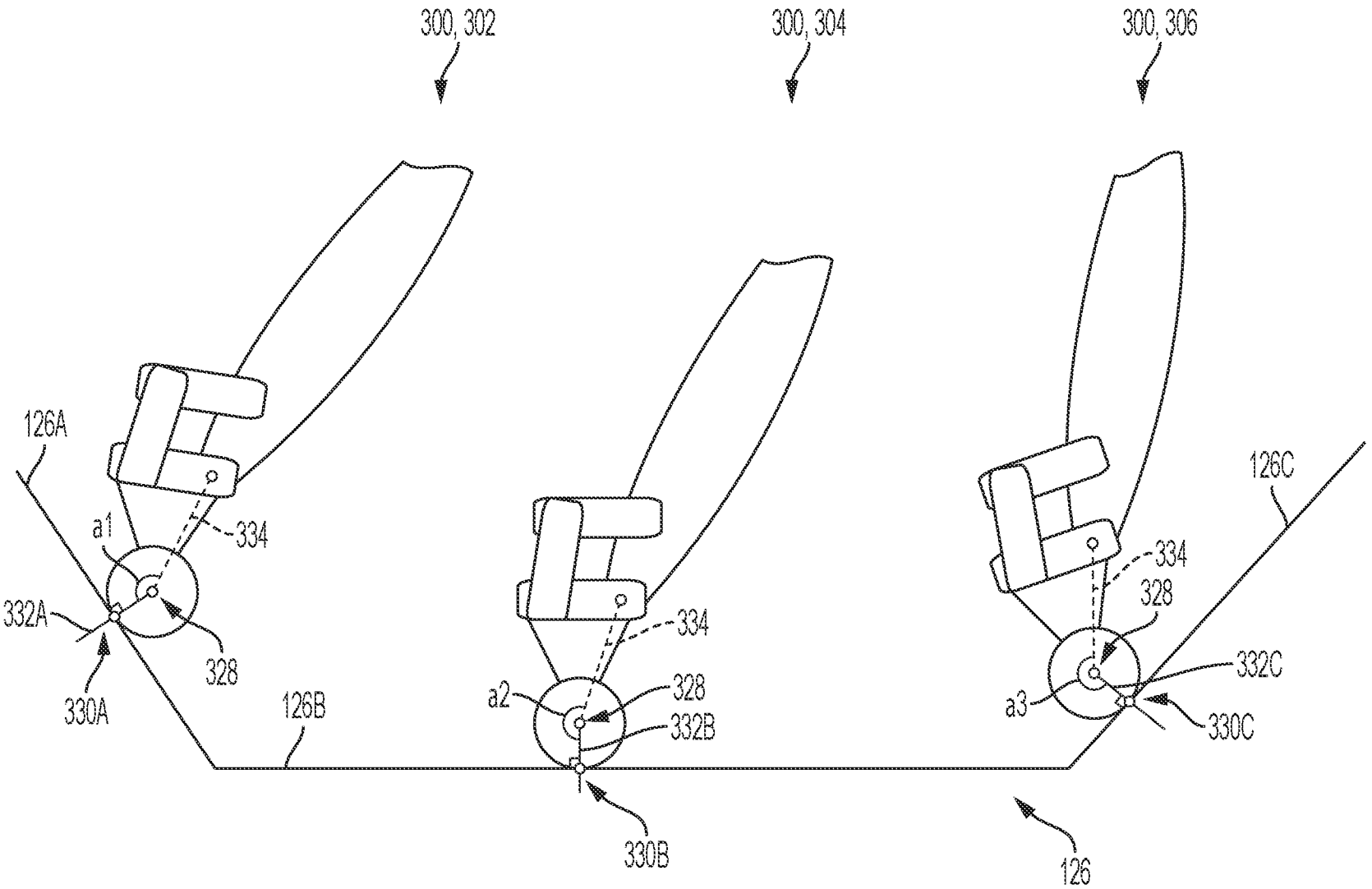
FIG. 5 is a side view of the earthmoving implement of FIG. 4 in three separate positions with respect to and in contact with a ground surface.

Referring to FIG. 4, an enlarged view of yet another embodiment of an earthmoving implement 314 as a circular implement for an earthmoving machine 300 is shown. The earthmoving machine 300 is generally similar to the earthmoving machine 100 except with respect to the earthmoving implement 314 and a linkage assembly 312 as described herein. The earthmoving implement 314 is coupled via a lower linkage of a linkage assembly 312 to the stick linkage 110 at a terminal point G. The linkage assembly 312 includes the lower linkage, an upper linkage connected to the stick linkage 110 above the terminal point G, and an intermediate linkage disposed an opposite ends of the lower and upper linkages. The intermediate linkage is coupled to the lower linkage at a lower linkage coupling point at an end of the lower linkage opposite of the terminal point G. A distance C is defined between the terminal point G and the lower linkage coupling point. A center point 328 of the earthmoving implement 314 is a distance B away from the lower linkage coupling point, and the center points 328 is a distance A away from the terminal point G. Distances A, B, and C are able to be measured and calibrated to determine a location of a rotary axis of center point 328 through the earthmoving implement 314. A radius D from the center point 328 to an outer surface of the earthmoving implement 314 may then be used to determine a position of an outer surface point 330 of the earthmoving implement with respect to a ground surface 126 such that the outer surface point 330 is normal to the ground surface 126 along vector 332 of the ground surface 126, as shown in FIG. 5 and described in greater detail below. The outer surface point 330 is dynamically changing with respect to a point that is normal to a selected portion of the ground surface 126. Determination of this dynamically changing point may then be used to control and provide guidance to the earthmoving implement 314 during a smoothing, compacting, and/or other grading of the ground surface 126.

FIG. 5 depicts a side view of the earthmoving implement 314 in three separate positions 302, 304, 306 with respect to and in contact with a ground surface 126. In position 302, the earthmoving implement 314 is disposed against left angled ground surface 126A at outer surface point 330A such that the outer surface point 330A is normal to the ground surface 126A along vector 332A of the ground surface 126. The outer surface point 330A is thus representative of a point of perpendicular intersection between the curve of the earthmoving implement 314 and the ground surface 126A along the vector 332A projecting from the ground surface 126A. The vector 332A, which is dynamic, is disposed at an angle $\alpha 1$ with respect to an axis 334 that is statically disposed between the terminal point G of the stick linkage 110 and the center point 328 of the earthmoving implement 314.

In position 304, the earthmoving implement 314 is disposed against an underlying ground surface 126B at outer surface point 330B such that the outer surface point 330B is normal to the ground surface 126B along vector 332B of the ground surface 126B. The outer surface point 330B is thus representative of a point of perpendicular intersection between the curve of the earthmoving implement 314 and the ground surface 126B along the vector 332B projecting from the ground surface 126B. The dynamic vector 332B is disposed at an angle $\alpha 2$ with respect to the static axis 334.

In position 306, the earthmoving implement 314 is disposed against right angled ground surface 126C at outer surface point 330C such that the outer surface point 330C is normal to the ground surface 126C along vector 332C of the ground surface 126C. The outer surface point 330C is thus representative of a point of perpendicular intersection between the curve of the earthmoving implement 314 and the ground surface 126C along the vector 332C projecting from the ground surface 126C. The dynamic vector 332C is disposed at an angle $\alpha 3$ with respect to the static axis 334. In the non-limiting, illustrated embodiments of FIG. 5, the angles $\alpha 1$, $\alpha 2$, and $\alpha 3$ are different with respect to one another as the respective outer surface points 330A, B, C dynamically change and are determined with respect to respective vectors 332A, B, C of respective ground surfaces 126A, 126B, 126C.

Referring again to FIG. 6, blocks 402-408 of the control scheme 400 illustrate the process the architecture controller of the control architecture 106 is programmed to execute. The process is executed by the architecture controller to determine a point of perpendicular intersection between an excavating implement 114, 214, 314 and a ground surface 126 as described herein.

In block 402, the architecture controller is programmed to generate a continuous differential surface (e.g., such as the superimposed curve 116 of FIG. 2) associated with a rear curved surface of the earthmoving implement 114, 214, 314, and to project the continuous differential surface onto a two-dimensional (2D) plane (such as an XY plane including an x-axis and a y-axis) associated with the earthmoving implement 114, 214, 314. As described herein with respect to FIGS. 1-2 and 4, the linkage assembly 112, 312 of the earthmoving implement 114, 214, 314 may include the boom linkage 108 and the stick linkage 110, each including a centerline. The 2D plane associated with the earthmoving implement 114, 214, 314 may pass through each centerline of the boom linkage 108 and the stick linkage 110. The boom linkage 108 may be coupled between the machine chassis 102 and the stick linkage 110, and an end of the stick linkage 110 may be coupled to the earthmoving implement 114, 214, 314, via the linkage assembly 112, 312.

In embodiments, to generate the continuous differential surface associated with the rear curved surface of the earthmoving implement 114 of FIG. 2, the architecture controller may be configured to locate a flat surface of a bottom of the earthmoving implement 114, locate a ground surface point of the ground surface 126 (FIG. 1), and position an initial curvature point (e.g., corresponding to point A) as one of one or more curvature points of a curvature of the earthmoving implement 114 extending from the flat surface onto the ground surface point of the ground surface 126. The one or more linkage assembly actuators may be used to lift and curl the earthmoving implement 114 to a subsequent curvature point (such as corresponding to point B) of the earthmoving implement 114 and to position the subsequent curvature point (e.g., corresponding to point B) onto the ground surface point 126. The subsequent curvature point is one of the one or more curvature points (e.g., corresponding to points A-F of FIG. 2). Further subsequent curvature points may continue to be located and positioned, each as one of the one or more curvature points, on the curvature of the earthmoving implement 114 on the ground surface point 126.

The one or more points (e.g., points A-F) of the rear curved surface of the excavating implement 114 may be mapped based on the one or more curvature points located and positioned on the ground surface 126. The one or more points (e.g., points A-F) mapping the rear curved surface of the earthmoving implement 114 may then be projected onto the 2D plane of the earthmoving implement 114. The continuous differential surface (e.g., the superimposed curve 116 of FIG. 2) associated with the rear curved surface of the earthmoving implement 114 may be generated based on the one or more points projected onto the 2D plane (e.g., the superimposed points 122 associated with points A-F of FIG. 2). A y-axis of the 2D plane may be defined by a vector disposed between the initial curvature point of the one or more curvature points and a final curvature point of the one or more curvature points. The one or more curvature points may include at least five curvature points (e.g., corresponding to points B-F), and the continuous differential surface may be mapped with a tangential line that starts on the flat surface of the bottom of the earthmoving implement 114 (e.g., starting at point A).

In embodiments in which the one or more curvature points are not strictly monotonically increasing, the earthmoving implement 114 may be bisected to create a bisection lane. Two separate projections may then be created for the one or more curvature points respectively below and above the bisection lane. The continuous differential surface may be generated based on the one or more curvature points respectively below and above the bisection lane.

In an aspect, the architecture controller may be configured to project k measured-up points associated with the rear curved surface of the earthmoving implement 114, 214, 314 onto the 2D plane. A y-axis of the 2D plane may then be defined as going from a first to a last of the k measured-up points, and the projected k measured-up points may be denoted as $x_k$ and $f(x_k)$ with respect an x-axis.

In block 404, the architecture controller is programmed to determine a piecewise-derivative continuous curve based on the continuous differential surface projected on to the 2D plane, and to determine a derivative of the piecewise-derivative continuous curve. To determine the piecewise-derivative continuous curve based on the continuous differential surface projected on to the 2D plane, the architecture controller may be configured to determine a smooth piecewise cubic function $p(x) \in C^1[I]$ that is differentiable with a single continuous derivative characterizing one or more points x defining the continuous differential surface projected on to the 2D plane. The smooth piecewise cubic function in each subinterval $I_i[x_i, x_{i+1}]$ is given by $$p(x)=f_iH_1(x)+f_{i+1}H_2(x)+d_iH_3(x)+d_{i+1}H_4(x), \quad \text{(Equation 1)}$$

where $H_1(x)=\varphi((x_{i+1}-x)/h_i)$, $H_2(x)=\varphi((x-x_i)/h_i)$, $H_3(x)=-h_i\psi((x_{i+1}-x)/h_i)$, $H_4(x)=h_i\psi(x-x_i)/h_i)$, and where $h_i=x_{i+1}-x_i$, $\varphi(t)=3t^2-2t^3$, and $\psi(t)=t^3-t^2$.

To determine the derivative of the piecewise-derivative continuous curve, the architecture controller may be configured to differentiate the piecewise-derivative continuous curve to determine the following:

$$\frac{\partial}{\partial x}dp(x) = f_i\frac{\partial}{\partial x}H_1(x) + f_{i+1}\frac{\partial}{\partial x}H_2(x) + d_i\frac{\partial}{\partial x}H_3(x) + d_{i+1}\frac{\partial}{\partial x}H_4(x), \quad \text{(Equation 2)}$$

$$\text{where } \frac{\partial}{\partial x}H_1(x) = \frac{1}{h_i}\left(6\left(\frac{(x_{i+1}-x)}{h_i}\right)^2 - 6\left(\frac{(x_{i+1}-x)}{h_i}\right)\right),$$

-continued $$\frac{\partial}{\partial x}H_2(x) = \frac{1}{h_i}\left(6\left(\frac{(x-x_i)}{h_i}\right) - 6\left(\frac{(x-x_i)}{h_i}\right)^2\right),$$

$$\frac{\partial}{\partial x}H_3(x) = 3\left(\frac{x_{i+1}-x}{h_i}\right)^2 - 2\left(\frac{x_{i+1}-x}{h_i}\right),$$

$$\frac{\partial}{\partial x}H_4(x) = 3\left(\frac{x-x_i}{h_i}\right)^2 - 2\left(\frac{x-x_i}{h_i}\right).$$

In block 406, the architecture controller is programmed to project a vector as a design plane normal n* (such as vectors 332, 332A, 332B, and 332C of FIGS. 4-5) of a ground surface 126 for smoothing onto the 2D plane associated with the earthmoving implement 114, 214, 314. In block 408, the architecture controller is programmed to determine a point of perpendicular intersection (such as at outer surface point 330, 330A, 330B, and 330B of FIGS. 4-5) between the derivative of the piecewise-derivative continuous curve and the design plane normal n* (such as vectors 332, 332A, 332B, and 332C of FIGS. 4-5) of the respective ground surface 126 projected onto the 2D plane. In embodiments, the architecture controller may further be programmed to operate the earthmoving machine 100, 300 using the one or more linkage assembly actuators and the determined and dynamically changing point of perpendicular intersection to smooth the ground surface 126.

To determine the point of perpendicular intersection between the derivative of the piecewise-derivative continuous curve and the design plane normal n* of the ground surface projected onto the 2D plane, the architecture controller may be configured to iterate over the regions from i=0 to i=n−1 and find the point of perpendicular intersection between the derivate $$\frac{\partial}{\partial x}dp(x)$$

and the design plane normal n* as defined by when $$\frac{\partial}{\partial x}dp(x) = -\frac{n_x^*}{n_y^*}.$$

In embodiments, when at least two points or zero points of perpendicular intersection are found, the point of perpendicular intersection selected may be a point nearest to an origin of the design plane normal n* of the ground surface 126. When at least two points are equidistant from the origin, the point of perpendicular intersection selected may be a point of the equidistant points that is furthest along a direction of travel of the earthmoving implement It is contemplated that the embodiments of the present disclosure may assist to permit a speedy and more cost efficient method of determining values to aid in grade control of a ground surface, and methods to operate an earthmoving implement based on such determined values, in a manner that minimizes a risk of human error with such value determinations. Further, the controller of the excavator or other control technologies are improved such that the processing systems are improved and optimized with respect to speed, efficiency, and output.

A signal may be "generated" by direct or indirect calculation or measurement, with or without the aid of a sensor.

For the purposes of describing and defining the present disclosure, it is noted that reference herein to a variable being a "function" of a parameter or another variable is not intended to denote that the variable is exclusively a function of the listed parameter or variable. Rather, reference herein to a variable that is a "function" of a listed parameter is intended to be open ended such that the variable may be a function of a single parameter or a plurality of parameters.

It is also noted that recitations herein of "at least one" component, element, etc., should not be used to create an inference that the alternative use of the articles "a" or "an" should be limited to a single component, element, etc.

It is noted that recitations herein of a component of the present disclosure being "configured" or "programmed" in a particular way, to embody a particular property, or to function in a particular manner, are structural recitations, as opposed to recitations of intended use. More specifically, the references herein to the manner in which a component is "configured" or "programmed" denotes an existing physical condition of the component and, as such, is to be taken as a definite recitation of the structural characteristics of the component.

It is noted that terms like "preferably," "commonly," and "typically," when utilized herein, are not utilized to limit the scope of the claimed disclosure or to imply that certain features are critical, essential, or even important to the structure or function of the claimed disclosure. Rather, these terms are merely intended to identify particular aspects of an embodiment of the present disclosure or to emphasize alternative or additional features that may or may not be utilized in a particular embodiment of the present disclosure.

For the purposes of describing and defining the present disclosure it is noted that the terms "substantially" and "approximately" are utilized herein to represent the inherent degree of uncertainty that may be attributed to any quantitative comparison, value, measurement, or other representation. The terms "substantially" and "approximately" are also utilized herein to represent the degree by which a quantitative representation may vary from a stated reference without resulting in a change in the basic function of the subject matter at issue.

Having described the subject matter of the present disclosure in detail and by reference to specific embodiments thereof, it is noted that the various details disclosed herein should not be taken to imply that these details relate to elements that are essential components of the various embodiments described herein, even in cases where a particular element is illustrated in each of the drawings that accompany the present description. Further, it will be apparent that modifications and variations are possible without departing from the scope of the present disclosure, including, but not limited to, embodiments defined in the appended claims. More specifically, although some aspects of the present disclosure are identified herein as preferred or particularly advantageous, it is contemplated that the present disclosure is not necessarily limited to these aspects.

It is noted that one or more of the following claims utilize the term "wherein" as a transitional phrase. For the purposes of defining the present disclosure, it is noted that this term is introduced in the claims as an open-ended transitional phrase that is used to introduce a recitation of a series of characteristics of the structure and should be interpreted in like manner as the more commonly used open-ended preamble term "comprising."

What is claimed is:

1. A grade control system comprising an earthmoving machine, wherein:

the earthmoving machine comprises a machine chassis, a linkage assembly, an earthmoving implement, and control architecture;

the control architecture comprises one or more linkage assembly actuators and an architecture controller programmed to:

generate a continuous differential surface associated with a rear curved surface of the earthmoving implement;

project the continuous differential surface onto a two-dimensional (2D) plane associated with the earthmoving implement;

determine a piecewise-derivative continuous curve based on the continuous differential surface projected on to the 2D plane;

determine a derivative of the piecewise-derivative continuous curve;

project a design plane normal n* of a ground surface for smoothing onto the 2D plane associated with the earthmoving implement;

determine a point of perpendicular intersection between the derivative of the piecewise-derivative continuous curve and the design plane normal n* of the ground surface projected onto the 2D plane; and operate the earthmoving machine using the one or more linkage assembly actuators and the point of perpendicular intersection to smooth the ground surface.

2. The grade control system as claimed in claim 1, wherein to generate the continuous differential surface associated with the rear curved surface of the earthmoving implement, the architecture controller is configured to:

locate a flat surface of a bottom of the earthmoving implement;

locate a ground surface point of the ground surface;

position an initial curvature point as one of one or more curvature points of a curvature of the earthmoving implement extending from the flat surface onto the ground surface point;

use the one or more linkage assembly actuators to lift and curl the earthmoving implement to a subsequent curvature point of the earthmoving implement;

position the subsequent curvature point as one of the one or more curvature points onto the ground surface point;

continue to locate and position subsequent curvature points each as one of the one or more curvature points on the curvature of the earthmoving implement on the ground surface point;

map one or more points of the rear curved surface of the earthmoving implement based on the one or more curvature points;

project the one or more points mapping the rear curved surface of the earthmoving implement onto the 2D plane of the earthmoving implement; and generate the continuous differential surface associated with the rear curved surface of the earthmoving implement based on the one or more points projected onto the 2D plane.

3. The grade control system as claimed in claim 2, wherein the one or more curvature points comprise at least five curvature points, and the continuous differential surface is mapped with a tangential line, the tangential line starting on the flat surface of the bottom of the earthmoving implement.

4. The grade control system as claimed in claim 2, wherein a y-axis of the 2D plane is defined by a vector disposed between the initial curvature point of the one or more curvature points and a final curvature point of the one or more curvature points.

5. The grade control system as claimed in claim 2, wherein when the one or more curvature points are not strictly monotonically increasing, the architecture controller is configured to:

bisect the earthmoving implement to create a bisection lane; and create two separate projections for the one or more curvature points respectively below and above the bisection lane; and generate the continuous differential surface based on the one or more curvature points respectively below and above the bisection lane.

6. The grade control system as claimed in claim 1, wherein the architecture controller is configured to:

when at least two points or zero points of perpendicular intersection are found, select as the point of perpendicular intersection a point nearest to an origin of the design plane normal n* of the ground surface.

7. The grade control system as claimed in claim 6, wherein the architecture controller is configured to:

when at least two points are equidistant from the origin, select as the point of perpendicular intersection a point of the equidistant points that is furthest along a direction of travel of the earthmoving implement.

8. The grade control system as claimed in claim 1, wherein to determine the piecewise-derivative continuous curve based on the continuous differential surface projected on to the 2D plane, the architecture controller is configured to:

determine a smooth piecewise cubic function $p(x) \in \mathcal{C}^1[I]$ that is differentiable with a single continuous derivative characterizing one or more points x defining the continuous differential surface projected on to the 2D plane, the smooth piecewise cubic function in each subinterval $I_i[x_i, x_{i+1}]$ given by $$p(x)=f_iH_1(x)+f_{i+1}H_2(x)+d_iH_3(x)+d_{i+1}H_4(x), \quad \text{(Equation 1)}$$

where $H_1(x)=\varphi((x_{i+1}-x)/h_i)$, $H_2(x)=\varphi((x-x_i)/h_i)$, $H_3(x)=-h_i\psi((x_{i+1}-x)/h_i)$, $H_4(x)=h_i\psi(x-x_i)/h_i)$, and where $h_i=x_{i+1}-x_i$, $\varphi(t)=3t^2-2t^3$, and $\psi(t)=t^3-t^2$.

9. The grade control system as claimed in claim 8, wherein to determine the derivative of the piecewise-derivative continuous curve, the architecture controller is configured to:

differentiate the piecewise-derivative continuous curve to determine the following:

$$\frac{\partial}{\partial x}dp(x) = f_i\frac{\partial}{\partial x}H_1(x) + f_{i+1}\frac{\partial}{\partial x}H_2(x) + d_i\frac{\partial}{\partial x}H_3(x) + d_{i+1}\frac{\partial}{\partial x}H_4(x),$$

$$\text{where } \frac{\partial}{\partial x}H_1(x) = \frac{1}{h_i}\left(6\left(\frac{(x_{i+1}-x)}{h_i}\right)^2 - 6\left(\frac{(x_{i+1}-x)}{h_i}\right)\right),$$

$$\frac{\partial}{\partial x}H_2(x) = \frac{1}{h_i}\left(6\left(\frac{(x-x_i)}{h_i}\right) - 6\left(\frac{(x-x_i)}{h_i}\right)^2\right),$$

$$\frac{\partial}{\partial x}H_3(x) = 3\left(\frac{x_{i+1}-x}{h_i}\right)^2 - 2\left(\frac{x_{i+1}-x}{h_i}\right),$$

$$\frac{\partial}{\partial x}H_4(x) = 3\left(\frac{x-x_i}{h_i}\right)^2 - 2\left(\frac{x-x_i}{h_i}\right).$$

10. The grade control system as claimed in claim 8, wherein to determine the point of perpendicular intersection between the derivative of the piecewise-derivative continuous curve and the design plane normal n* of the ground surface projected onto the 2D plane, the architecture controller is configured to:

iterate over regions from i=0 to i=n−1 and find the point of perpendicular intersection between the derivate $$\frac{\partial}{\partial x}dp(x)$$

and the design plane normal n* as defined by when $$\frac{\partial}{\partial x}dp(x) = -\frac{n_x^*}{n_y^*}$$

11. The grade control system as claimed in claim 1, wherein the control architecture comprises a non-transitory computer-readable storage medium comprising machine readable instructions.

12. The grade control system as claimed in claim 1, wherein the one or more linkage assembly actuators facilitate movement of the linkage assembly.

13. The grade control system as claimed in claim 12, wherein the one or more linkage assembly actuators comprise a hydraulic cylinder actuator, a pneumatic cylinder actuator, an electrical actuator, a mechanical actuator, or combinations thereof.

14. The grade control system as claimed in claim 1, the linkage assembly of the earthmoving implement comprising a boom linkage and a stick linkage each comprising a centerline, wherein the 2D plane associated with the earthmoving implement passes through each centerline of the boom linkage and the stick linkage.

15. The grade control system as claimed in claim 14, wherein the boom linkage is coupled between the machine chassis and the stick linkage, and an end of the stick linkage is coupled to the earthmoving implement.

16. The grade control system as claimed in claim 15, wherein linkages of the linkage assembly further comprise an implement linkage, a rear side linkage, a dogbone linkage, and a front side linkage to couple the end of the stick linkage to the earthmoving implement.

17. A grade control system comprising an earthmoving machine, wherein:

the earthmoving machine comprises a machine chassis, a linkage assembly, an earthmoving implement, and control architecture;

the linkage assembly of the earthmoving implement comprising a boom linkage and a stick linkage each comprising a centerline;

the control architecture comprises one or more linkage assembly actuators that facilitate movement of the linkage assembly and an architecture controller programmed to:

generate a continuous differential surface associated with a rear curved surface of the earthmoving implement;

project the continuous differential surface onto a two-dimensional (2D) plane associated with the earthmoving implement, wherein the 2D plane associated with the earthmoving implement passes through each centerline of the boom linkage and the stick linkage;

determine a piecewise-derivative continuous curve based on the continuous differential surface projected on to the 2D plane;

determine a derivative of the piecewise-derivative continuous curve;

project a design plane normal n* of a ground surface for smoothing onto the 2D plane associated with the earthmoving implement;

determine a point of perpendicular intersection between the derivative of the piecewise-derivative continuous curve and the design plane normal n* of the ground surface projected onto the 2D plane; and operate the earthmoving machine using the one or more linkage assembly actuators and the point of perpendicular intersection to smooth the ground surface.

18. The grade control system as claimed in claim 17, wherein to generate the continuous differential surface associated with the rear curved surface of the earthmoving implement, the architecture controller is configured to:

locate a flat surface of a bottom of the earthmoving implement;

locate a ground surface point of the ground surface;

position an initial curvature point as one of one or more curvature points of a curvature of the earthmoving implement extending from the flat surface onto the ground surface point;

use the one or more linkage assembly actuators to lift and curl the earthmoving implement to a subsequent curvature point of the earthmoving implement;

position the subsequent curvature point as one of the one or more curvature points onto the ground surface point;

continue to locate and position subsequent curvature points each as one of the one or more curvature points on the curvature of the earthmoving implement on the ground surface point;

map one or more points of the rear curved surface of the earthmoving implement based on the one or more curvature points;

project the one or more points mapping the rear curved surface of the earthmoving implement onto the 2D plane of the earthmoving implement; and generate the continuous differential surface associated with the rear curved surface of the earthmoving implement based on the one or more points projected onto the 2D plane.

19. A method to operate a grade control system comprising an earthmoving machine, the earthmoving machine comprising a machine chassis, a linkage assembly, an earthmoving implement, and control architecture comprising one or more linkage assembly actuators and an architecture controller, the method comprising:

generating, via the architecture controller, a continuous differential surface associated with a rear curved surface of the earthmoving implement;

projecting the continuous differential surface onto a two-dimensional (2D) plane associated with the earthmoving implement;

determining a piecewise-derivative continuous curve based on the continuous differential surface projected on to the 2D plane;

determining a derivative of the piecewise-derivative continuous curve;

projecting a design plane normal n* of a ground surface for smoothing onto the 2D plane associated with the earthmoving implement;

determining, via the architecture controller, a point of perpendicular intersection between the derivative of the piecewise-derivative continuous curve and the design plane normal n* of the ground surface projected onto the 2D plane; and operating the earthmoving machine using the architecture controller, the one or more linkage assembly actuators, and the point of perpendicular intersection to smooth the ground surface.

20. The method as claimed in claim 19, further comprising:

locating a flat surface of a bottom of the earthmoving implement;

locating a ground surface point of the ground surface;

positioning an initial curvature point as one of one or more curvature points of a curvature of the earthmoving implement extending from the flat surface onto the ground surface point;

using the one or more linkage assembly actuators to lift and curl the earthmoving implement to a subsequent curvature point of the earthmoving implement;

positioning the subsequent curvature point as one of the one or more curvature points onto the ground surface point;

continuing to locate and position subsequent curvature points each as one of the one or more curvature points on the curvature of the earthmoving implement on the ground surface point;

mapping one or more points of the rear curved surface of the earthmoving implement based on the one or more curvature points;

projecting the one or more points mapping the rear curved surface of the earthmoving implement onto the 2D plane of the earthmoving implement; and generating the continuous differential surface associated with the rear curved surface of the earthmoving implement based on the one or more points projected onto the 2D plane.

* * * * *